US009375829B2

(12) United States Patent
Su

(10) Patent No.: US 9,375,829 B2
(45) Date of Patent: Jun. 28, 2016

(54) TOOL HEAD

(71) Applicant: Hong Ann Tool Industries Co., Ltd., Taichung (TW)

(72) Inventor: Cheng-Wei Su, Taichung (TW)

(73) Assignee: HONG ANN TOOL INDUSTRIES CO., LTD., Taichung (TW)

( * ) Notice: Subject to any disclaimer, the term of this patent is extended or adjusted under 35 U.S.C. 154(b) by 0 days.

(21) Appl. No.: 13/705,263

(22) Filed: Dec. 5, 2012

(65) Prior Publication Data

US 2013/0340577 A1 Dec. 26, 2013

(30) Foreign Application Priority Data

Jun. 21, 2012 (TW) ..... 101122176 A

(51) Int. Cl.
*B25B 23/00* (2006.01)

(52) U.S. Cl.
CPC ..... *B25B 23/0035* (2013.01)

(58) Field of Classification Search
CPC .. B25B 23/12; B25B 23/108; B25B 23/0035; B25B 23/1427; B25B 23/0021; B25B 13/06; B25B 13/065; B25B 13/48; B25B 15/001; B25G 1/005; B25G 1/025; A61B 17/8875; A61C 1/186
USPC ..... 81/436–439, 177.85, 121.1; 279/143, 8, 279/91, 101
See application file for complete search history.

(56) References Cited

U.S. PATENT DOCUMENTS

| | | | | |
|---|---|---|---|---|
| 5,074,173 | A * | 12/1991 | Cearley | B25B 13/483 81/125 |
| 6,745,652 | B2 * | 6/2004 | Chen | 81/438 |
| 7,051,630 | B2 | 5/2006 | Lee | |
| 7,104,164 | B2 * | 9/2006 | Jirele | B25B 23/108 7/100 |
| 7,261,023 | B2 | 8/2007 | Taguchi | |
| 8,109,183 | B2 | 2/2012 | Santamarina et al. | |
| 8,549,963 | B2 | 10/2013 | Chuang | |
| 2004/0065176 | A1 * | 4/2004 | Lin | B25B 23/12 81/125 |
| 2006/0269179 | A1 * | 11/2006 | Miyasaka et al. | 384/279 |
| 2010/0294092 | A1 * | 11/2010 | Hu | B25B 13/481 81/438 |

FOREIGN PATENT DOCUMENTS

| | | | |
|---|---|---|---|
| TW | M369832 | U | 12/2009 |
| TW | M374939 | U | 3/2010 |
| TW | 201129449 | A | 9/2011 |
| TW | 352648 | I | 11/2011 |
| TW | M422455 | U | 2/2012 |
| TW | 201210762 | A | 3/2012 |

* cited by examiner

*Primary Examiner* — Monica Carter
*Assistant Examiner* — Melanie Alexander
(74) *Attorney, Agent, or Firm* — Alan D. Kamrath; Kamrath IP Lawfirm, P.A.

(57) ABSTRACT

A tool head includes a connecting component, a driving component, and a spacer. The connecting component includes a receiving end defining a tight-fit section and a non tight-fit section. The driving component is insertably fitted in the receiving end of the connecting component, and includes a body defining first and second engaging sections. The second engaging section is received in the non tight-fit section. The spacer includes first and second tight-fit edges, with the first engaging section tightly fit in the tight-fit section by the spacer, with the first tight-fit edge tightly abutting against a wall delimiting the tight-fit section, and with the second tight-fit edge tightly abutting against a wall delimiting the first engaging section, respectively.

18 Claims, 13 Drawing Sheets

TOOL HEAD

BACKGROUND OF THE INVENTION

1. Field of the Invention

The present invention relates to a tool head and, particularly, to a tool head not susceptible to breakage easily.

2. Description of the Related Art

A conventional tool head includes a connecting end for connecting the tool head to a tool or a tool handle and a driving end for driving an object to be driven. Generally, the conventional tool head is a one-piece structure and is made of relatively harder material to withstand the object to be driven and which wears the tool head when the tool head is driven to drive the object to be driven.

Some conventional tool heads have a relative longer longitudinal length for specific tools or tool handles, and are made in two pieces in order to save material and cost. Such conventional tool head includes a connecting member and a driving member fitted in the connecting member. In order for the driving member to be tightly fitted in the connecting member, the connecting member has greater hardness than that of the driving member. Unfortunately, such conventional tool head is not strong enough to undergo a relatively large toque when the connected tool or tool handle starts turning it, and is also susceptible to breakage when being rotated rapidly.

TW Patent No. I352,648 discloses a connecting member and a driving member fitted in the connecting member. The driving member includes a connecting portion, a polygonal shaped portion extending from the connecting portion, and a cylindrical shaped portion extending from the polygonal shaped portion. The connecting, polygonal shaped and cylindrical shaped portions are coaxial with one another. Additionally, an outer diametrical size of the cylindrical shaped portion is smaller than that of the polygonal shaped portion. The connecting member includes a polygonal shaped slot, a cylindrical shaped slot extending from polygonal shaped slot, and a receiving slot. The polygonal shaped slot receives the polygonal shaped portion, with peripheral surfaces thereof abutted against each other when the driving member is fitted in the connecting member. Likewise, the cylindrical shaped slot receives the cylindrical shaped portion, with the peripheral surfaces tightly abutted against each other when the driving member is fitted in the connecting member. It is appreciated that the driving member would not withstand large toque and is also susceptible to breakage for the reason as set forth.

The present invention is, therefore, intended to obviate or at least alleviate the problems encountered in the prior art.

SUMMARY OF THE INVENTION

According to the present invention, a tool head includes a connecting component, a driving component, and a spacer. The connecting component includes a connecting end and a receiving end defining a tight-fit section and a non tight-fit section. The tool head is adapted to be connected to a tool, with the tool engaged in the connecting end. The driving component is insertably fitted in the connecting component, and includes a body defining first and second engaging sections and a driving end, with the second engaging section between the first engaging section and the driving end. The second engaging section is received in the non tight-fit section. The driving end is used for engaging with an object to be driven. The spacer includes first and second tight-fit edges. The first engaging section is tightly fit in the tight-fit section by the spacer. The first tight-fit edge is tightly abutted against a wall delimiting the tight-fit section, and the second tight-fit edge is tightly abutted against a wall delimiting the first engaging section, respectively.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure. The abstract is neither intended to define the invention, which is measured by the claims, nor is it intended to be limiting as to the scope of the invention in any way.

It is an object of the present invention to provide a tool head that overcomes the set forth problems.

It is another object of the present invention to provide a tool head having a structure strong enough to withstand high torque transmission.

It is another object of the present invention to provide a tool head made of two pieces.

Other objects, advantages, and new features of the present invention will become apparent from the following detailed description of the invention when considered in conjunction with the accompanied drawings.

DETAILED DESCRIPTION OF THE INVENTION

Figure 1:
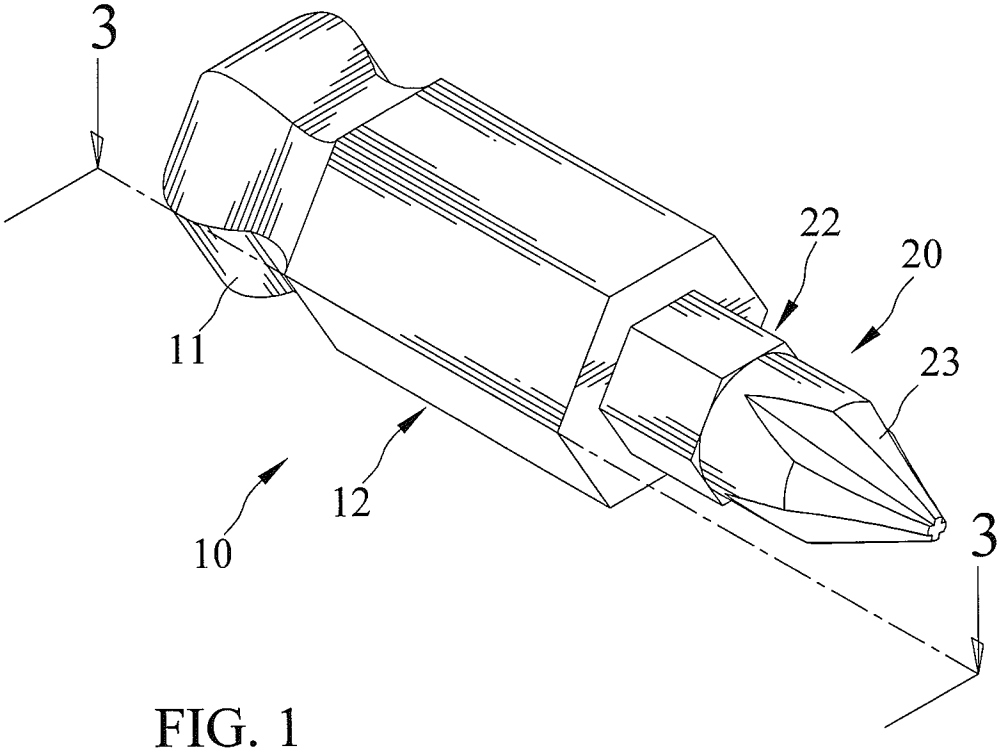
FIG. 1 is a perspective view of a tool head in accordance with a first embodiment of the present invention.
Figure 2:
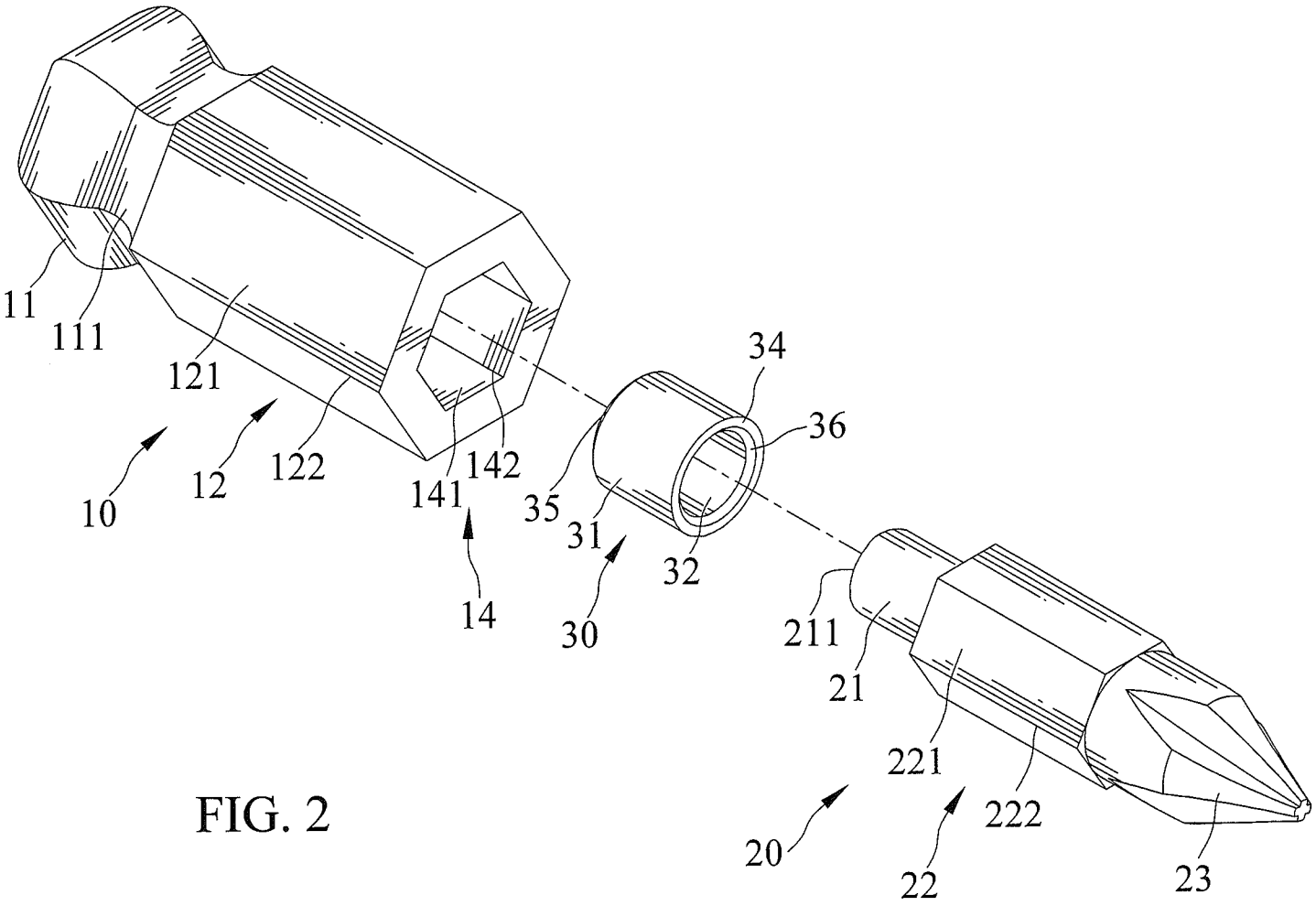
FIG. 2 is an exploded perspective view of the tool head of FIG. 1.
Figure 3:
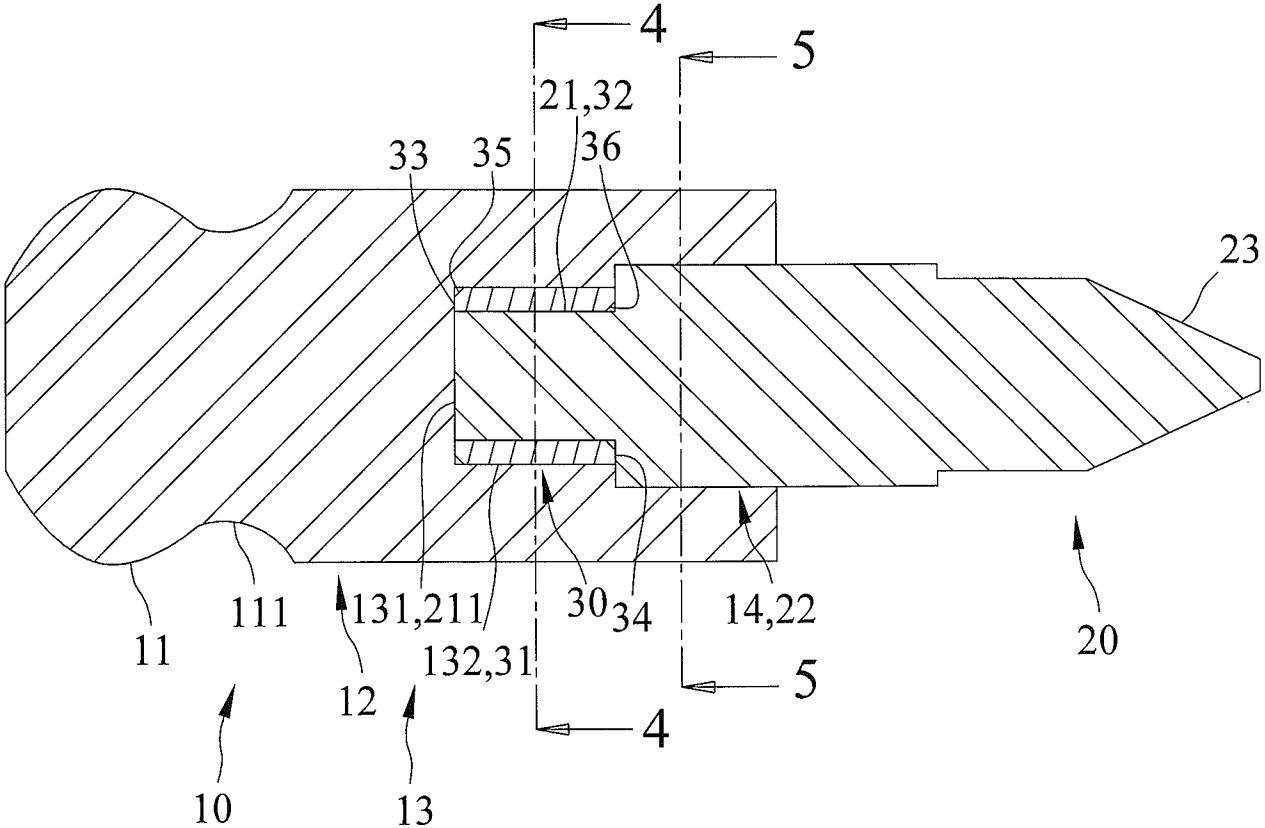
FIG. 3 is a cross-sectional view taken along line 3-3 of the tool head of FIG. 1.
Figure 5:
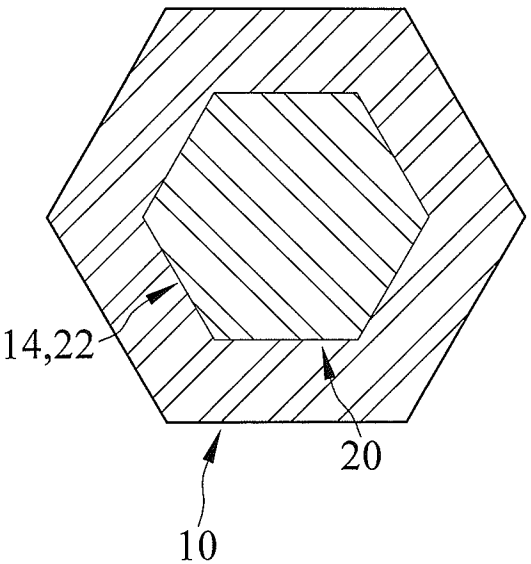
FIG. 5 is a cross-sectional view taken along line 5-5 of the tool head of FIG. 3.
Figure 4:
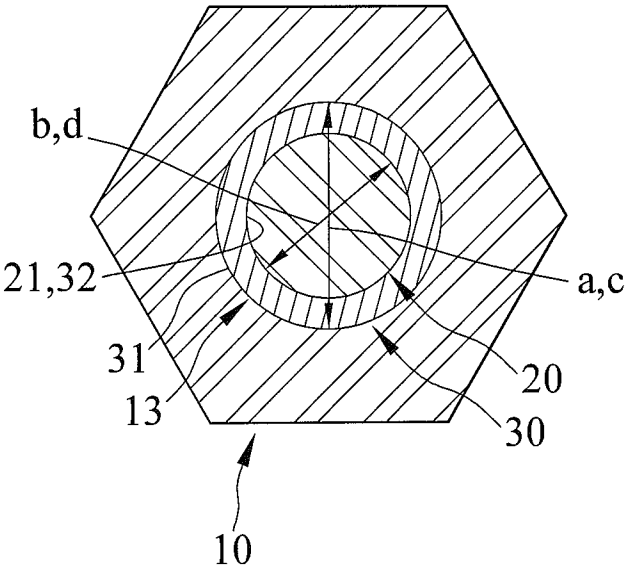
FIG. 4 is a cross-sectional view taken along line 4-4 of the tool head of FIG. 3.
Figure 6:
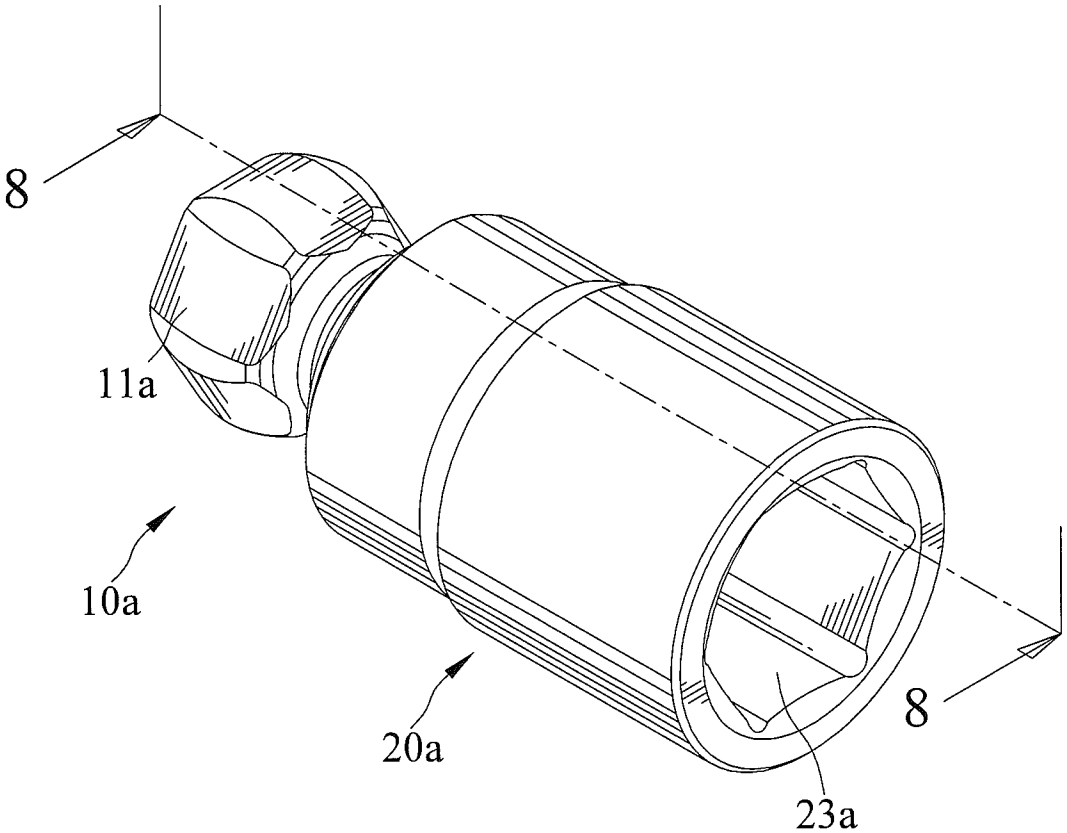
FIG. 6 is a perspective view of a tool head in accordance with a second embodiment of the present invention.
Figure 7:
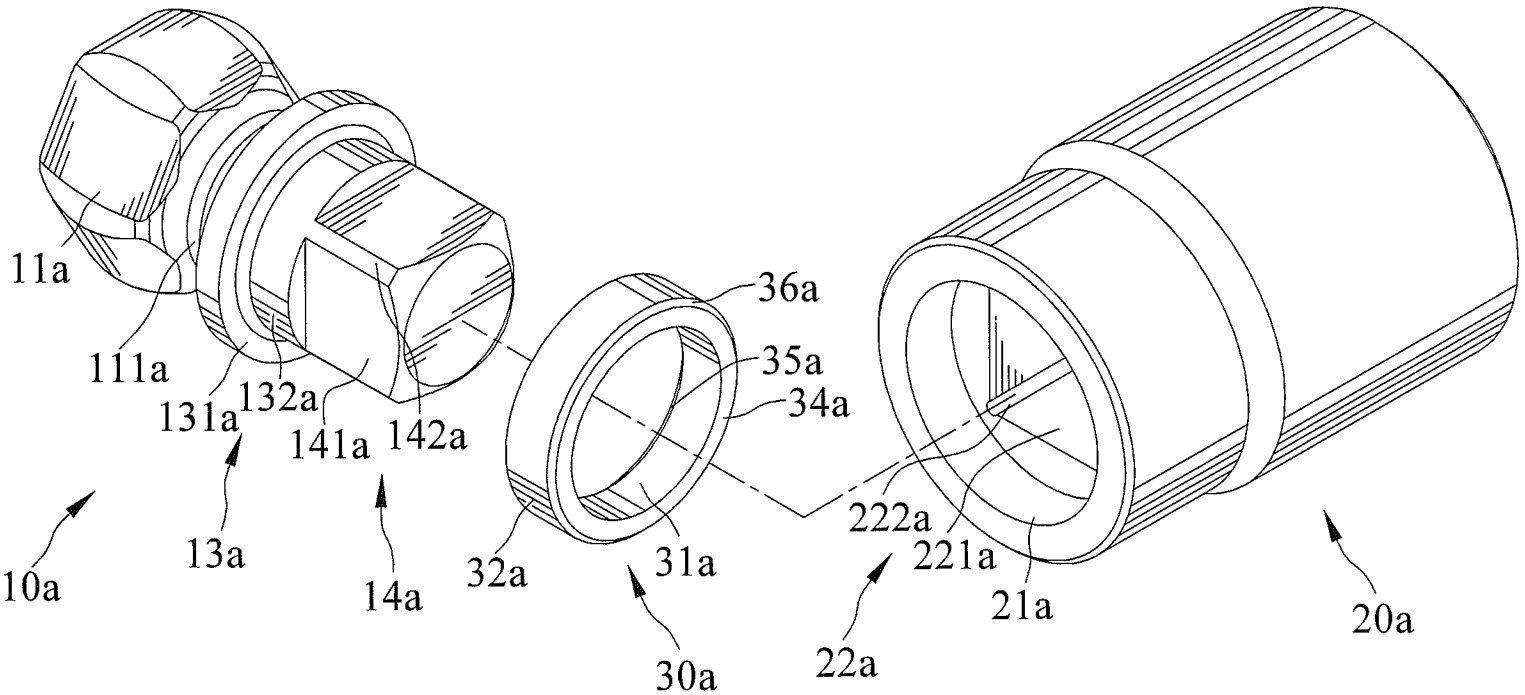
FIG. 7 is an exploded perspective view of the tool head of FIG. 6.
Figure 8:
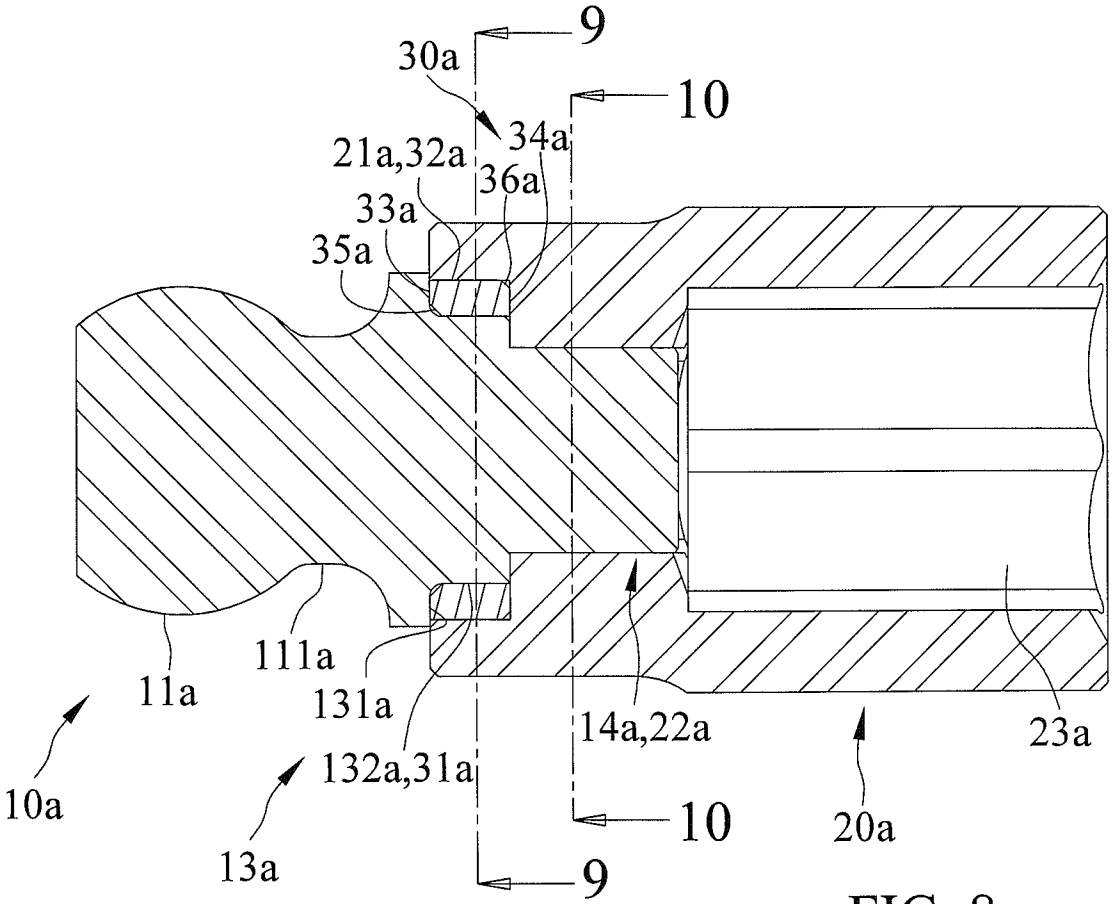
FIG. 8 is a cross-sectional view taken along line 8-8 of the tool head of FIG. 6.
Figure 10:
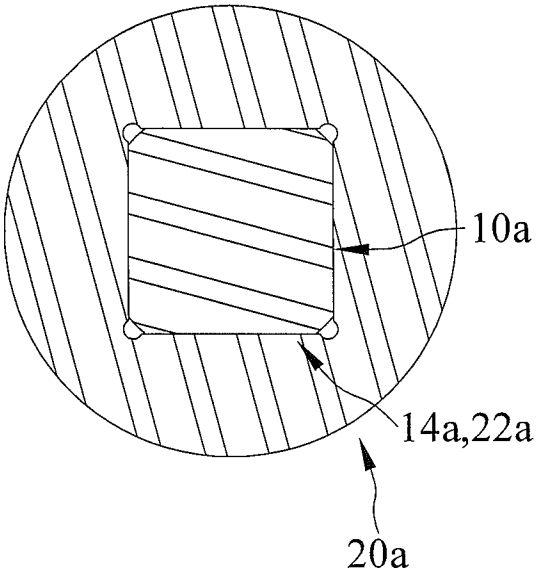
FIG. 10 is a cross-sectional view taken along line 10-10 of the tool head of FIG. 8.
Figure 9:
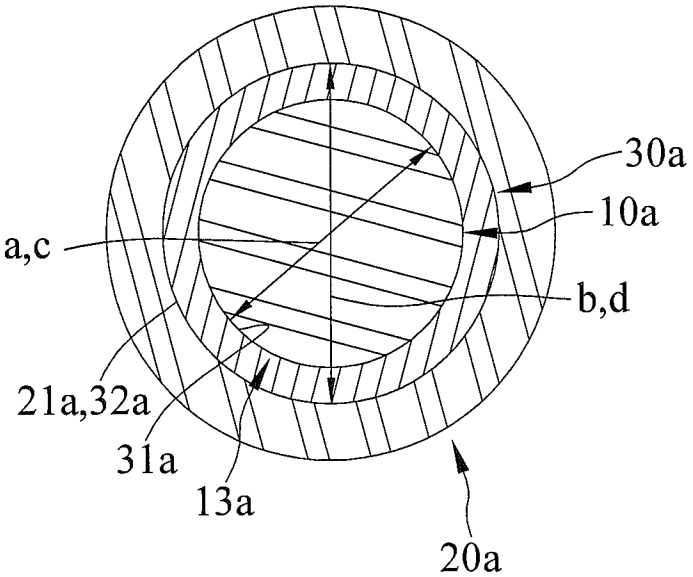
FIG. 9 is a cross-sectional view taken along line 9-9 of the tool head of FIG. 8.

FIGS. 1 through 5 show a tool head in accordance with a first embodiment of the present invention including a connecting component 10, a driving component 20, and a spacer 30.

The connecting component 10 includes a connecting end 11 and a receiving end 12 defining a tight-fit section 13 and a non tight-fit section 14. The tool head is adapted to be connected to a pneumatic tool or an electric tool, with the tool engaged in the connecting end 11. The connecting component 10 includes the connecting end 11 and the receiving end 12 on two ends thereof. The connecting end 11 is substantially of a spherical geometry. The receiving end 12 includes a chamber defining the tight-fit section 13 and the non tight-fit section 14. The tight-fit section 13 includes an enclosed side 131 and a lateral side 132 defined from a wall delimiting the tight-fit section 13 and extending from the enclosed side 131 to a wall delimiting the non tight-fit section 14. Cross sections of an outer peripheral edge of the receiving end 12 and the wall delimiting the non tight-fit section 14 have similar geometry, with sides of the cross section of the wall delimiting the non tight-fit section 14 corresponding to and proportionally smaller than sides of the cross section of the outer peripheral edge of the receiving end 12. The outer peripheral edge of the receiving end 12 and the wall delimiting the non tight-fit section 14 have polygonal cross sections corresponding to each other. The outer peripheral edge of the receiving end 12 and the wall delimiting the non tight-fit section 14 have hexagonal cross sections corresponding to each other. The outer peripheral edge of the receiving end 12 has an equilateral and equiangular geometry defining a plurality of first flat sides 121 and a plurality of first angles 122. The wall delimiting the non tight-fit section 14 has an equilateral and equiangular geometry defining a plurality of second flat sides 141 corresponding to the respective first flat sides 121 and also a plurality of second angles 142 corresponding to respective first angles 122. Further, a neck 111 is extended between and interconnects the connecting end 11 and the receiving end 12, with the neck 111 having a smaller diametrical size than the connecting end 11 and the receiving end 12. The neck 111 enables stable connection between the connecting component 10 and the pneumatic tool or the electric tool connected thereto.

The connecting component 10 has a smaller hardness than the driving component 20. The driving component 20 is insertably fitted in the connecting component 10, and includes a body defining first and second engaging sections 21 and 22 and a driving end 23, with the second engaging section 22 being between the first engaging section 21 and the driving end 23. The first engaging section 21 is received in the tight-fit section 13, and the second engaging section 22 is received in the non tight-fit section 14, respectively. An outer periphery edge of the second engaging section 22 has an equilateral and equiangular geometry defining a plurality of third flat sides 221 corresponding to and abutted against the respective second flat sides 141 and a plurality of third angles 222 corresponding to respective second angles 142. The first engaging section 21 also includes an end 211 abutted against the enclosed side 131. The driving end 23 is used for engaging with an object to be driven. The driving component 20 is a bit and includes the driving end 23 of a shape fit for a particular slot of a fastener. Additionally, the first and second engaging sections 21 and 22 have different diametrical sizes.

The spacer 30 has a smaller hardness than the connecting component 10. The spacer 30 includes first and second tight-fit edges 31 and 32. Furthermore, the spacer 30 includes a first end 33 and a second end 34 opposite to the first end 33, with the first end 33 including a first chamfer 35 and with the second end 34 including a second chamfer 36 respectively, with the first chamfer 35 facilitating engagement of the spacer 30 into the tight-fit section 13, with the second chamfer 36 facilitating engagement of the second tight-fit edge 32 on the first engaging section 21. The first engaging section 21 is tightly fit in the tight-fit section 13 by the spacer 30, with the first tight-fit edge 31 tightly abutting against the wall delimiting the tight-fit section 13, with the second tight-fit edge 32 tightly abutting against a wall delimiting first engaging section 21, respectively, and with the first end 33 abutted against the enclosed side 131. Additionally, the first tight-fit edge 31 and the tight-fit section 13 are tight fitted together through a punching process, and the second tight-fit edge 32 and the first engaging section 21 are tightly fitted together through a punching process.

The wall delimiting the tight-fit section 13 has a circular cross section. The wall delimiting the first engaging section 21 has a circular cross section. The spacer 30 is ring-shaped and includes an outer periphery with a cross section conforming to the wall delimiting the tight-fit section 13 and an inner periphery with a cross section conforming to the wall delimiting the first engaging section 21, respectively. The spacer 30 includes the outer periphery with a cross section, which conforms to a cross section of the wall delimiting the tight-fit section 13, being circular, but not limiting. Likewise, the spacer 30 includes the inner periphery with a cross section, which conforms to a cross section of the wall delimiting first engaging section 21, being circular, but not limiting. Furthermore, the wall delimiting the tight-fit section 13 has a first diametrical size a, and the outer periphery of the spacer 30 has a third diametrical size c equaling the first diametrical size a. Likewise, the wall delimiting first engaging section 21 has a second diametrical size b, and the inner periphery of the spacer 30 has a fourth diametrical size d equaling the second diametrical size b.

FIGS. 6 through 10 show a tool head in accordance with a second embodiment of the present invention, and same numbers are used to correlate similar components of the first embodiment, but bearing a letter a. The differences between the first and second embodiments are that a connecting component 10*a* includes a connecting end 11*a* and a protrusion defining tight-fit and non tight-fit sections 13*a* and 14*a* thereof. A neck 111*a* enables stable connection between the connecting component 10*a* and the pneumatic or electric tool connected thereto. The connecting component 10*a* includes a flange and an enclosed side 131*a* thereof delimiting a side of the flange. A driving component 20*a* is in the form of a socket and a driving end 23*a* thereof forming a chamber. The driving component 20*a* includes a first engaging section 21*a* thereof forming a chamber. A spacer 30*a* and a lateral side 132*a* of the tight-fit section 13*a* of the connecting component 10*a* are disposed in the first engaging section 21*a*. The spacer 30*a* includes first and second tight-fit edges 31*a* and 32*a* and a first end 33*a* and a second end 34*a* opposite to the first end 33*a*, with the first end 33*a* including a first chamfer 35*a* and with the second end 34*a* including a second chamfer 36*a*. The first engaging section 21*a* includes an end thereof both abutted against the enclosed side 131*a*. Cross sections of a wall delimiting the non tight-fit section 14*a* and a periphery edge of a plurality of third flat sides 221*a* of the second engaging section 22*a* have similar geometry. The periphery edge of the plurality of third flat sides 221*a* of the second engaging section 22*a* and the wall delimiting second flat sides 141*a* of the non tight-fit section 14*a* have polygonal cross sections corresponding to each other and including a plurality of second angles 142*a*. The periphery edge of the plurality of third flat sides 221*a* of the second engaging section 22*a* and the wall delimiting the second flat sides 141*a* of the non tight-fit section 14*a* have substantially quadrilateral cross sections corresponding to each other and including a plurality of third angles 222*a*.

Figure 11:
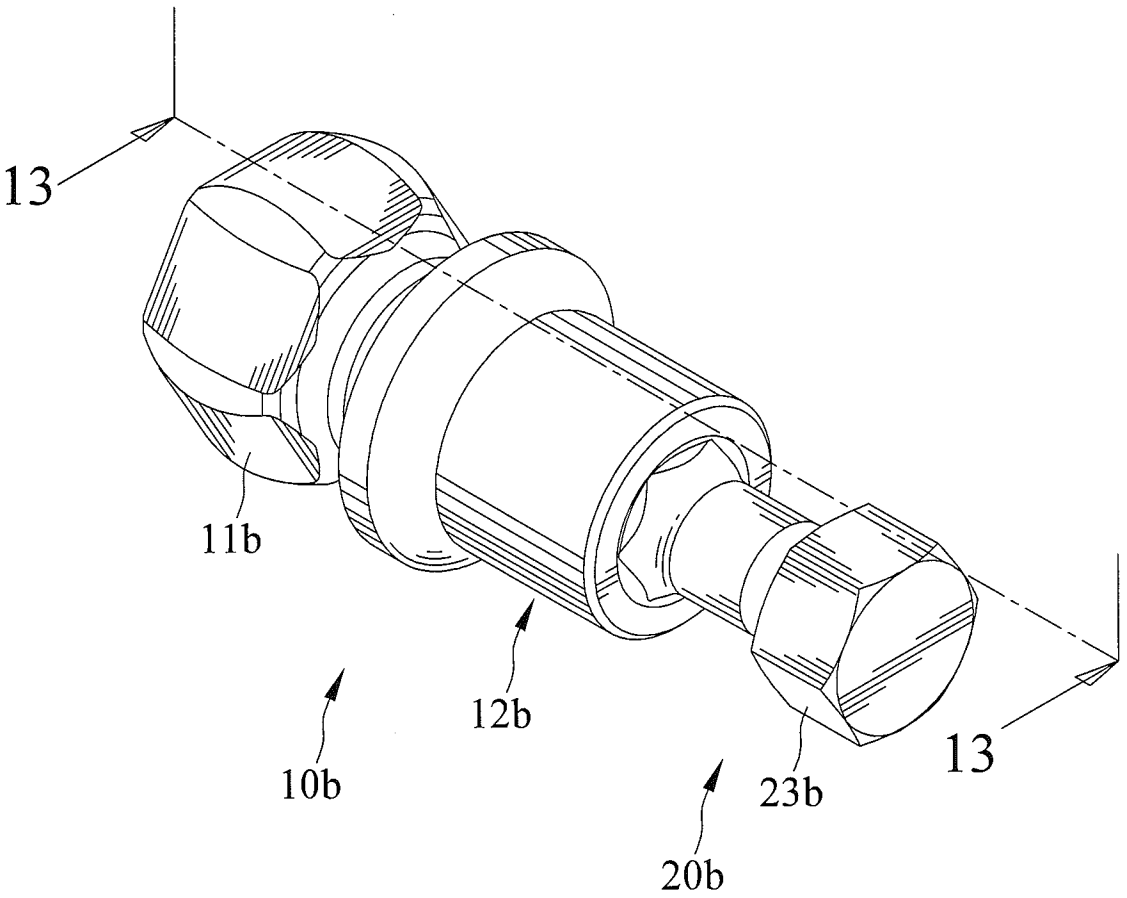
FIG. 11 is a perspective view of a tool head in accordance with a third embodiment of the present invention.
Figure 12:
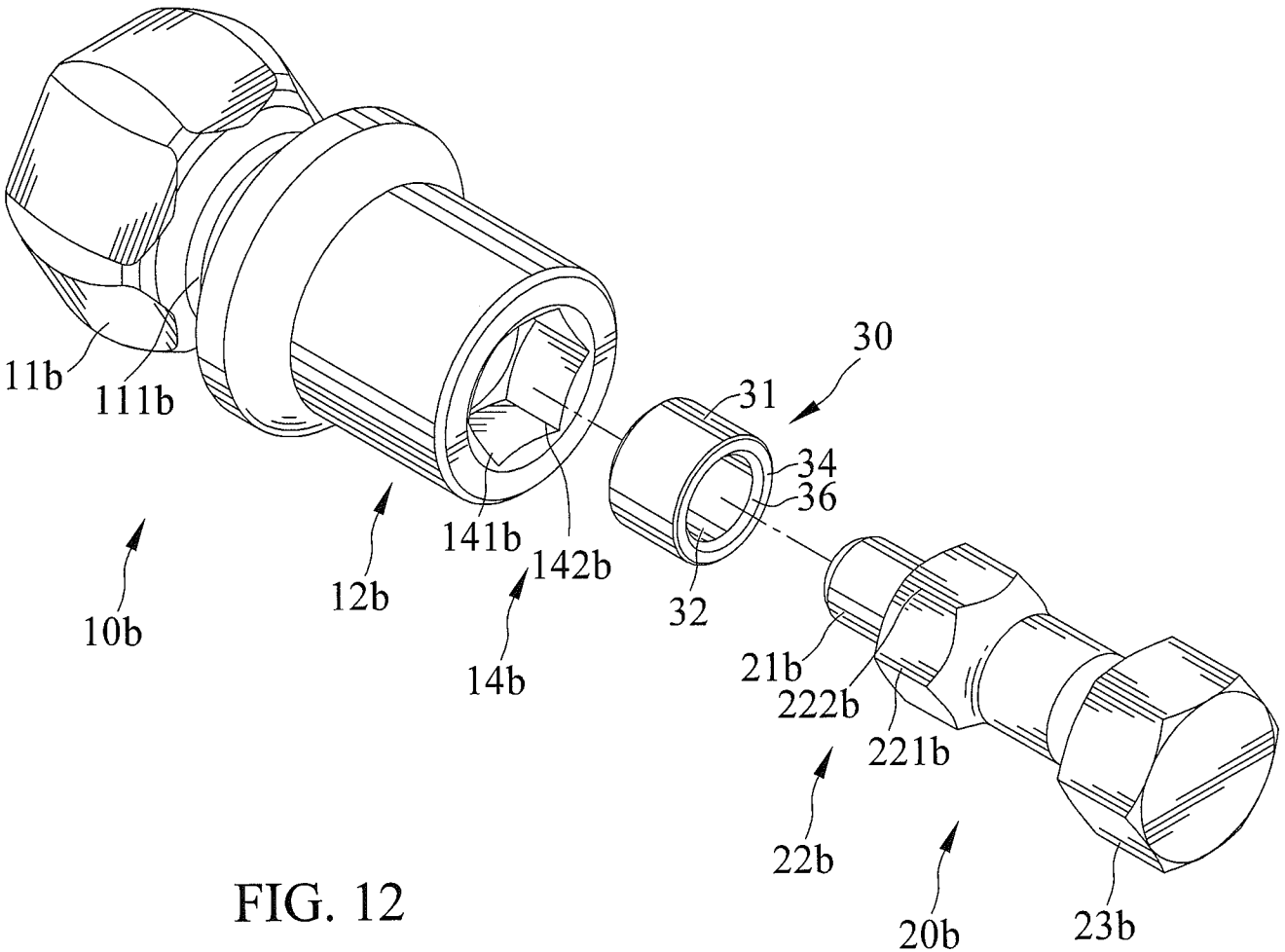
FIG. 12 is an exploded perspective view of the tool head of FIG. 12.
Figure 13:
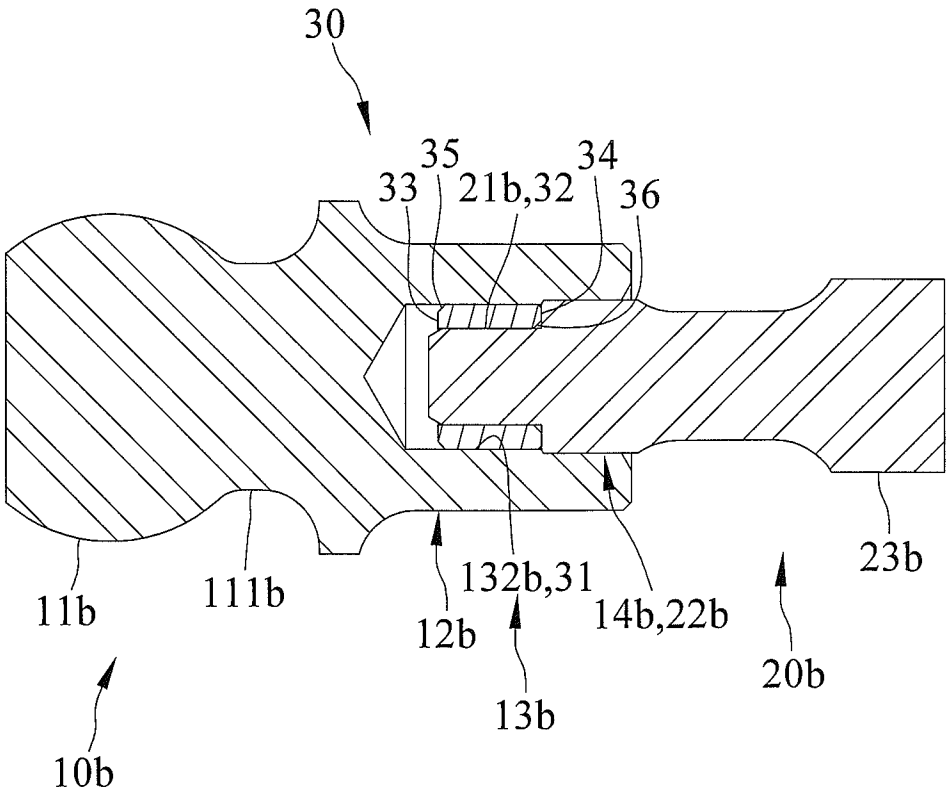
FIG. 13 is a cross-sectional view taken along line 13-13 of the tool head of FIG. 11.

FIGS. 11 through 13 show a tool head in accordance with a third embodiment of the present invention, and same numbers are used to correlate similar components of the first embodiment, but bearing a letter b. The differences between the first and third embodiments are that a connecting component 10*b* includes a connecting end 11*b* and a receiving end 12*b* thereof forming a chamber defining tight-fit and non tight-fit sections 13*b* and 14*b* thereof. A neck 111*b* enables stable connection between the connecting component 10*b* and the pneumatic or electric tool connected thereto. A driving component 20*b* includes a first engaging section 21*b* thereof tightly fit in the tight-fit section 13*b* by the spacer 30 and a second engaging section 22*b* thereof received in the non tight-fit section 14*b*, respectively. The driving component 20*b* includes a driving end 23*b* thereof forming a hexagonal driving head. A lateral side 132*b* of the tight-fit section 13*b* is disposed in the first engaging section 21*b*. Cross sections of a wall delimiting the non tight-fit section 14*b* and a periphery edge of a plurality of third flat sides 221*b* of the second engaging section 22*b* have similar geometry. The periphery edge of the plurality of third flat sides 221*b* of the second engaging section 22*b* and the wall delimiting second flat sides 141*b* of the non tight-fit section 14*b* have polygonal cross sections corresponding to each other and including a plurality of second angles 142*b*. The periphery edge of the plurality of third flat sides 221*b* of the second engaging section 22*b* and the wall delimiting the second flat sides 141*b* of the non tight-fit section 14*b* have hexagonal cross sections corresponding to each other and including a plurality of third angles 222*b*.

Figure 14:
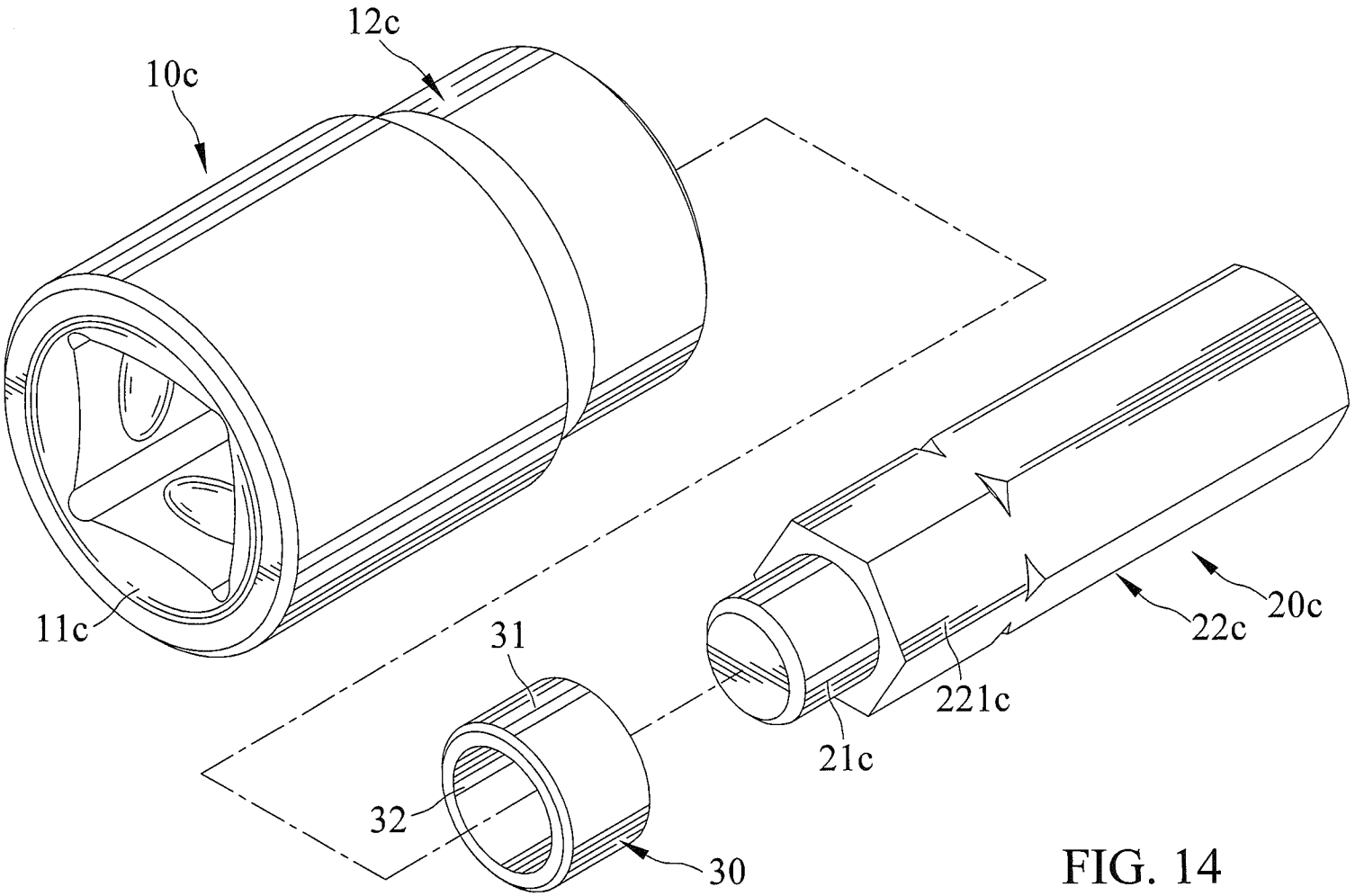
FIG. 14 is an exploded perspective view of a tool head in accordance with a fourth embodiment of the present invention.
Figure 15:
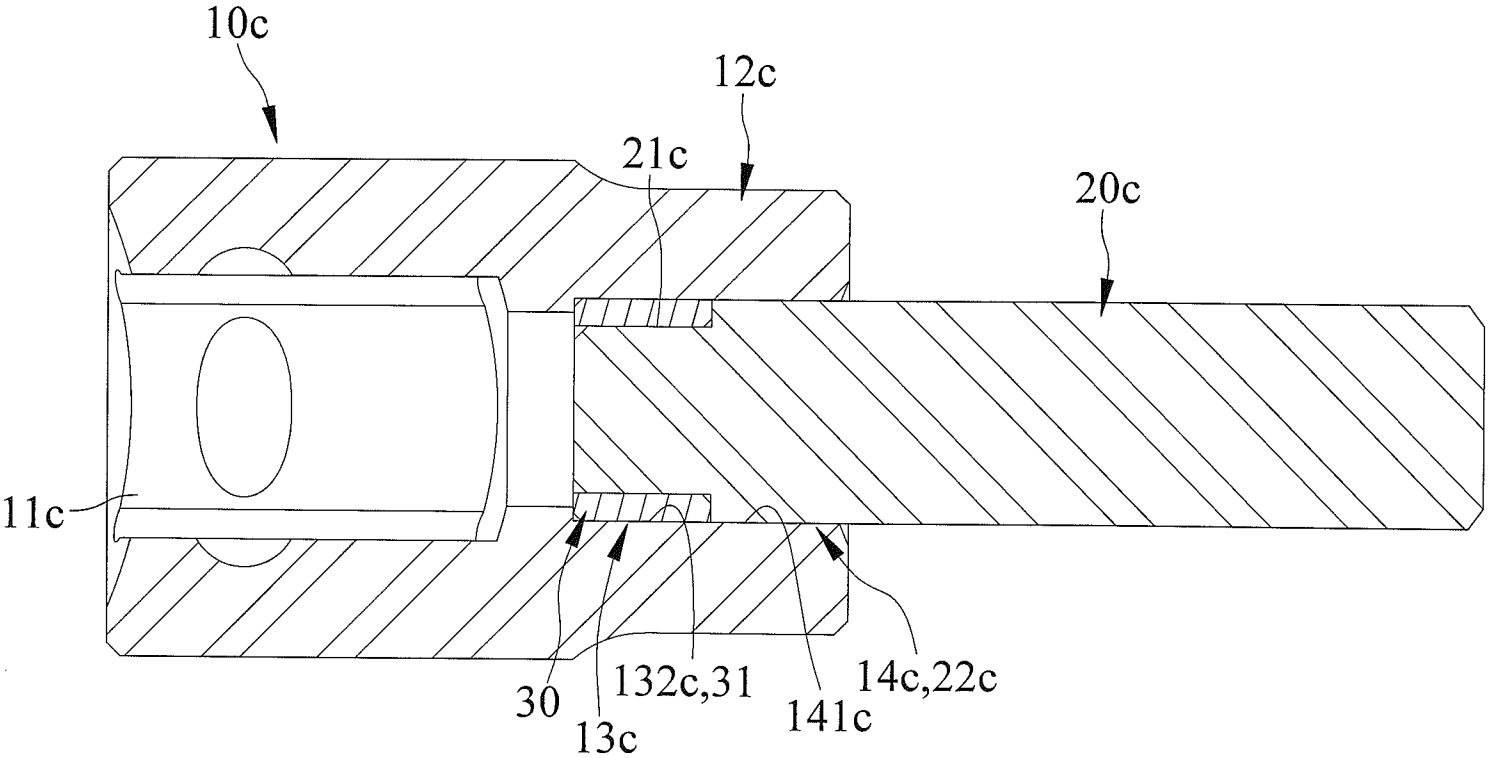
FIG. 15 is a cross-sectional view of the tool head of FIG. 14.

FIGS. 14 and 15 show a tool head in accordance with a fourth embodiment of the present invention, and same numbers are used to correlate similar components of the first embodiment, but bearing a letter c. The differences between the first and third embodiments are that a connecting component 10*c* includes a receiving end 12*c* thereof forming a chamber defining tight-fit and non tight-fit sections 13*c* and 14*c* thereof. The connecting component 10*c* includes a connecting end 11*c* thereof forming a chamber, although not shown, but can also apply to the second embodiment. The connecting end 11*c* has a substantially quadrilateral cross section. A driving component 20*c* includes a first engaging section 21*c* thereof tightly fit in the tight-fit section 13*c* by the spacer 30 and a second engaging section 22*c* thereof received in the non tight-fit section 14*c*, respectively. A lateral side 132*c* of the tight-fit section 13*c* is disposed in the first engaging section 21*c*. Cross sections of a wall delimiting the non tight-fit section 14*c* and a periphery edge of a plurality of third flat sides 221*c* of the second engaging section 22*c* have similar geometry. The periphery edge of the plurality of third flat sides 221*c* of the second engaging section 22*c* and the wall delimiting second flat sides 141*c* of the non tight-fit section 14*c* have polygonal cross sections corresponding to each other. The periphery edge of the plurality of third flat sides 221*b* of the second engaging section 22*b* and the wall delimiting the second flat sides 141*b* of the non tight-fit section 14*b* have hexagonal cross sections corresponding to each other.

In view of the forgoing, the connecting component 10, 10*a*, 10*b*, and 10*c* and the driving component 20, 20*a*, 20*b*, and 20*c* are tightly engaged with each other by the spacer 30 and 30*a*, and the spacer 30 and 30*a* has a smaller hardness than the connecting component 10, 10*a* 10*b*, and 10*c* and the connecting component 10, 10*a* 10*b*, and 10*c* has a smaller hardness than the driving component 20, 20*a*, 20*b*, and 20*c*. Therefore, the connecting component 10, 10*a*, 10*b*, and 10*c* and the driving component 20, 20*a*, 20*b* and 20*c* will not abrade with each other, and the tool head can withstand high torque transmission.

While the specific embodiments have been illustrated and described, numerous modifications come to mind without significantly departing from the spirit of invention, and the scope of invention is only limited by the scope of accompanying claims.

What is claimed is:

1. A tool head comprising:

a connecting component including a connecting end and a receiving end defining a tight-fit section and a non tight-fit section, with the connecting end adapted to be connected to a tool, with the tight-fit section intermediate the non tight-fit section and the connecting end, with the connecting component having an axial extent between the connecting end and the receiving end;

a driving component insertably fitted relative the connecting component and including a body defining first and second engaging sections and a driving end, with the second engaging section being between the first engaging section and the driving end, with the second engaging section received in the non tight-fit section to prevent relative rotation between the second engaging section and the non tight-fit section, with the driving end used for engaging with an object to be driven; and a spacer including first and second tight-fit edges, with the first engaging section tightly fit in the tight-fit section by the spacer, with the first tight-fit edge tightly abutting against a wall delimiting the tight-fit section and the second tight-fit edge tightly abutting against a wall delimiting the first engaging section respectively, with the spacer located intermediate the second engaging section and the connecting end, wherein the spacer has a smaller hardness than the connecting component, and wherein the connecting component has a smaller hardness than the driving component, and wherein the spacer is located within the axial extent of the connecting component;

wherein the receiving end is a stud, with the tight-fit section having a size, with the non tight-fit section having a size smaller than the size of the tight-fit section, and with the first tight-fit edge of the spacer having a size larger than the size of the non tight-fit section.

2. The tool head as claimed in claim 1, wherein the connecting component includes a neck interconnecting the connecting end and the receiving end, and wherein the neck has a smaller diametrical size than the connecting end and the receiving end.

3. The tool head as claimed in claim 2, wherein the driving component is in a form of a socket and includes the driving end thereof forming a chamber, wherein the receiving end of the connecting component includes a protrusion defining the tight-fit and non tight-fit sections, wherein the driving component includes the first engaging section thereof forming a chamber, and wherein a lateral side of the tight-fit section of the connecting component and the spacer are disposed in the first engaging section.

4. The tool head as claimed in claim 3, wherein cross sections of the wall delimiting the tight-fit section and the second tight-fit edge of the spacer are circular and conformed to each other, wherein cross sections of the wall delimiting the first engaging section and the first tight-fit edge of the spacer are circular and conformed to each other, and wherein cross sections of a wall delimiting the non tight-fit section and an inner periphery edge of the second engaging section are polygonal and conformed to each other, respectively.

5. The tool head as claimed in claim 1, wherein the driving component is in a form of a socket and includes the driving end thereof forming a chamber, wherein the receiving end of the connecting component includes a protrusion defining the tight-fit and non tight-fit sections, wherein the driving component includes the first engaging section thereof forming a chamber, and wherein a lateral side of the tight-fit section of the connecting component and the spacer are disposed in the first engaging section.

6. The tool head as claimed in claim 5, wherein cross sections of the wall delimiting the tight-fit section and the second tight-fit edge of the spacer are circular and conformed to each other, wherein cross sections of the wall delimiting the first engaging section and the first tight-fit edge of the spacer are circular and conformed to each other, and wherein cross sections of a wall delimiting the non tight-fit section and an inner periphery edge of the second engaging section are polygonal and conformed to each other, respectively.

7. A tool head comprising:

a connecting component including a connecting end and a receiving end defining a tight-fit section and a non tight-fit section, with the connecting end adapted to be connected to a tool, with the tight-fit section intermediate the non tight-fit section and the connecting end, with the connecting component having an axial extent between the connecting end and the receiving end;

a driving component insertably fitted relative the connecting component and including a body defining first and second engaging sections and a driving end, with the second engaging section being between the first engaging section and the driving end, with the second engaging section received in the non tight-fit section to prevent relative rotation between the second engaging section and the non tight-fit section, with the driving end used for engaging with an object to be driven; and a spacer including first and second tight-fit edges, with the first engaging section tightly fit in the tight-fit section by the spacer, with the first tight-fit edge tightly abutting against a wall delimiting the tight-fit section and the second tight-fit edge tightly abutting against a wall delimiting the first engaging section respectively, with the spacer located intermediate the second engaging section and the connecting end, wherein the spacer has a smaller hardness than the connecting component, and wherein the connecting component has a smaller hardness than the driving component, and wherein the spacer is located within the axial extent of the connecting component;

wherein the receiving end comprises a bore, with the tight-fit and non tight-fit sections having identical cross sections, and wherein the first tight-fit edge of the spacer and the second engaging section have identical cross sections.

8. The tool head as claimed in claim 7, wherein cross sections of the wall delimiting the tight-fit section and the first tight-fit edge of the spacer are circular and conformed to each other, wherein cross sections of the wall delimiting the first engaging section and the second tight-fit edge of the spacer are circular and conformed to each other, and wherein cross sections of an outer periphery edge of the second engaging section and a wall delimiting the non tight-fit section are polygonal and conformed to each other, respectively.

9. The tool head as claimed in claim 8, wherein the receiving end forms a chamber of an axial length defining the tight-fit section and the non tight-fit section, with the spacer having an axial length less the axial length of the chamber.

10. The tool head as claimed in claim 9, wherein the driving component is a bit and includes the driving end of a shape fit for a particular slot of the object in a form of a fastener.

11. The tool head as claimed in claim 7, wherein the spacer includes a first end and a second end opposite to the first end, with the first end including a first chamfer extending between the first tight-fit edge and the first end and the second end including a second chamfer extending between the second tight-fit edge and the second end, with the first chamfer facilitating engagement of the spacer into the tight-fit section, with the second chamfer facilitating engagement of the second tight-fit edge on the first engaging section.

12. The tool head as claimed in claim 11, wherein cross sections of the wall delimiting the tight-fit section and the first tight-fit edge of the spacer are circular and conformed to each other, wherein cross sections of the wall delimiting the first engaging section and the second tight-fit edge of the spacer are circular and conformed to each other, and wherein cross sections of an outer periphery edge of the second engaging section and a wall delimiting the non tight-fit section are polygonal and conformed to each other, respectively.

13. The tool head as claimed in claim 12, wherein the receiving end forms a chamber of an axial length defining the tight-fit section and the non tight-fit section, with the spacer having an axial length less the axial length of the chamber.

14. The tool head as claimed in claim 13, wherein the driving component is a bit and includes the driving end of a shape fit for a particular slot of the object in a form of a fastener.

15. The tool head as claimed in claim 7, wherein the tight-fit section includes an enclosed side and a lateral side defined from the wall delimiting the tight-fit section, with the lateral side extending from the enclosed side to a wall delimiting the non tight-fit section.

16. The tool head as claimed in claim 15, wherein the spacer includes a first end and the first engaging section includes an end both abutted against the enclosed side.

17. The tool head as claimed in claim 7, wherein the first and second engaging sections have different diametrical sizes.

18. The tool head as claimed in claim 7, wherein the connecting component includes the connecting end thereof forming a chamber.

* * * * *